US010393079B2

(12) United States Patent
Roth et al.

(10) Patent No.: US 10,393,079 B2
(45) Date of Patent: Aug. 27, 2019

(54) VALVE DEVICE FOR CONTROLLING OR METERING A FLUID

(75) Inventors: Heiko Roth, Heilbronn (DE); Dominik Brunner, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 492 days.

(21) Appl. No.: 14/002,273

(22) PCT Filed: Jan. 4, 2012

(86) PCT No.: PCT/EP2012/050093

§ 371 (c)(1),
(2), (4) Date: Nov. 4, 2013

(87) PCT Pub. No.: WO2012/116850

PCT Pub. Date: Sep. 7, 2012

(65) Prior Publication Data

US 2014/0048043 A1 Feb. 20, 2014

(30) Foreign Application Priority Data

Mar. 20, 2011 (DE) ..... 10 2011 004 993

(51) Int. Cl.
*F02M 59/46* (2006.01)
*F02M 59/36* (2006.01)
*F02M 63/00* (2006.01)

(52) U.S. Cl.
CPC ..... *F02M 59/466* (2013.01); *F02M 59/366* (2013.01); *F02M 59/367* (2013.01);
(Continued)

(58) Field of Classification Search
CPC ..... F02M 63/0031; F02M 63/0033; F02M 63/0077; F02M 63/0078; F02M 59/466;
(Continued)

(56) References Cited

U.S. PATENT DOCUMENTS 4,337,788 A * 7/1982 Seger ..... E21B 34/02 137/315.02
4,503,814 A * 3/1985 Fujihara ..... F01P 3/2207 123/41.3

(Continued)

FOREIGN PATENT DOCUMENTS

CN 1875184 A 12/2006
DE 199 34 715 A1 3/2000

(Continued)

OTHER PUBLICATIONS

International Search Report corresponding to PCT Application No. PCT/EP2012/050093, dated Mar. 27, 2012 (German and English language document) (7 pages).

*Primary Examiner* — Hung Q Nguyen
*Assistant Examiner* — Brian P Monahon
(74) *Attorney, Agent, or Firm* — Maginot, Moore & Beck LLP

(57) ABSTRACT

A valve device for controlling or metering a fluid includes a housing, a flow duct formed in the housing, and a valve body arranged in the flow duct. The valve body has a sealing section which, when the valve device is closed, rests on a sealing seat on the housing. The sealing section and sealing seat together form a sealing region. When the valve device is closed, a decay chamber is defined immediately upstream of the sealing region in the flow duct. The decay chamber is bounded by a baffle wall that is tilted with respect to the normal to the sealing region at an angle of at most 15° in the flow direction to 60° counter to the flow direction.

13 Claims, 8 Drawing Sheets

(52) U.S. Cl.
CPC ..... *F02M 59/462* (2013.01); *F02M 63/00* (2013.01); *F02M 63/0077* (2013.01); *F02M 63/0078* (2013.01)

(58) Field of Classification Search
CPC .... F02M 63/00; F02M 59/366; F02M 59/367; F02M 59/462; F16K 1/32; F16K 1/42; F16K 25/00; F16K 25/02; F16K 25/04; F16K 1/34; F16K 125/04
USPC ..... 251/356, 359, 333
See application file for complete search history.

(56) References Cited

U.S. PATENT DOCUMENTS 4,640,255 A * 2/1987 Hafele ..... F02M 55/001 123/495
4,836,498 A * 6/1989 Heron ..... F16K 47/04 251/126
4,915,354 A * 4/1990 Sims, Jr. ..... F16K 1/42 251/334
4,926,902 A * 5/1990 Nakamura ..... F02M 59/462 123/467
5,810,328 A * 9/1998 Boehland ..... F02M 41/1411 123/458
5,921,473 A * 7/1999 Romann ..... F02M 51/0657 239/533.2
5,950,650 A * 9/1999 Pacht ..... G05D 16/2013 137/1
6,039,031 A * 3/2000 Ricco ..... F02M 47/027 123/470
6,105,610 A * 8/2000 Watkins, II ..... F16K 15/04 137/516.29
6,349,920 B1 2/2002 Lewis et al.
6,378,502 B1 * 4/2002 Betz ..... F02M 47/027 123/467
6,427,932 B1 * 8/2002 Danckert ..... F02M 61/18 123/467
6,505,812 B1 * 1/2003 Anastas ..... F16K 41/10 251/129.07
6,631,706 B1 * 10/2003 Yamada ..... F02M 59/442 123/447
6,752,170 B2 * 6/2004 Muramatsu ..... F02M 69/54 123/459
7,225,831 B2 * 6/2007 Hope ..... F16K 15/025 137/516.27
7,303,194 B2 * 12/2007 Smith, III ..... F16J 15/0887 137/614.04
7,537,194 B2 * 5/2009 Nagai ..... F16K 1/38 251/122
7,780,144 B2 * 8/2010 Van Der Linden ..... F02M 59/462 137/539
7,819,637 B2 * 10/2010 Oda ..... F02M 59/366 251/129.07
7,832,653 B2 * 11/2010 Yukimoto ..... F16K 47/04 236/92 B
8,342,203 B2 * 1/2013 Weaver ..... B65D 77/225 137/533.17
2003/0024571 A1 * 2/2003 Simmons ..... F16K 15/04 137/329.05
2003/0056758 A1 * 3/2003 Onishi ..... F02M 55/04 123/446
2004/0016420 A1 * 1/2004 Hess ..... F02M 59/34 123/497
2007/0063159 A1 * 3/2007 Rodriguez-Amaya ..... F02M 47/027 251/129.16
2007/0119991 A1 * 5/2007 Schuerg ..... F02M 59/366 239/584
2008/0217421 A1 * 9/2008 Lewis ..... F02M 57/023 239/5
2008/0257430 A1 * 10/2008 Best ..... F16K 1/42 137/596.2
2010/0116910 A1 * 5/2010 Girlinger ..... F02M 47/027 239/533.3
2011/0123376 A1 * 5/2011 Aritomi ..... F02M 59/462 417/540
2011/0209784 A1 * 9/2011 Stein ..... F04B 7/0076 137/561 R

FOREIGN PATENT DOCUMENTS

DE 10 2008 000 658 A1 10/2008
EP 1 251 267 A2 10/2002
EP 1 471 248 A1 10/2004
EP 1 717 446 A2 11/2006
JP 5-195910 A 8/1993
JP 6-22669 U 3/1994
JP 7-253170 A 10/1995
JP 2000-55215 A 2/2000
JP 2006-177365 A 7/2006
JP 2006-329180 A 12/2006
JP 2006329180 A * 12/2006 ..... F02M 59/464
JP 2007-146861 A 6/2007
JP 2008-248788 A 10/2008

* cited by examiner

VALVE DEVICE FOR CONTROLLING OR METERING A FLUID

This application is a 35 U.S.C. § 371 National Stage Application of PCT/EP2012/050093, filed on Jan. 4, 2012, which claims the benefit of priority to Serial No. DE 10 2011 004 993.2, filed on Mar. 2, 2011 in Germany, the disclosures of which are incorporated herein by reference in their entirety.

BACKGROUND

The disclosure relates to a valve device and to a quantity control valve as disclosed herein.

Valve devices, for example quantity control valves of a fuel system of an internal combustion engine, are known from the marketplace. Valve devices of this type frequently have a valve body which can come into contact with a housing-side sealing seat at a sealing section and can therefore close the valve device. The sealing seat is, for example, of flat, cylindrical, spherical or conical configuration. In the closed state of the valve device, pressure pulses can occur in the hydraulic lines which are connected to the valve device, as a result of which a liquid vapor ("vapor bubbles") can be produced in the region of the sealing section and the sealing seat. The implosion of said vapor bubbles results in what is known as cavitation erosion on surrounding sections of the housing and/or the valve body.

SUMMARY

The problem on which the disclosure is based is solved by way of a valve device and a quantity control valve as disclosed herein. Advantageous developments are specified in the subclaims. Furthermore, features which are important for the disclosure are found in the following description and in the drawings; the features can be important for the disclosure on their own and also in different combinations, without reference being made to this again explicitly.

The valve device according to the disclosure has the advantage that the resistance to cavitation erosion in the region of a sealing seat and/or a sealing section of the valve device is improved. Here, the flow coefficient and the pressure drop along a flow channel, as well as the valve lift, the valve switching time and the long-term strength of the valve device remain substantially unchanged.

The disclosure proceeds from the consideration that a high resistance to cavitation erosion in a sealing region which is formed by a sealing section and a sealing seat on the one hand and a high flow coefficient of the valve device on the other hand can be conflicting requirements. Although it is possible to increase the flow coefficient of the valve device with an unchanged valve lift by means of bevels or rounded portions which are positioned immediately upstream of the sealing region, this results in a gap with a wedge-like cross section between the sealing section and the sealing seat when the valve device is closed. Independently of the respective pressure, the bubbles in the fluid which are formed on account of cavitation effects will decay in said gap after all and therefore comparatively quickly, as a result of which erosion of the sealing section and/or the sealing seat can occur.

According to the disclosure, when the valve device is closed, the valve device has a decaying space in a flow channel immediately upstream of the sealing region. Here, a bounding wall of the decaying space is formed by a deflector wall which adjoins the sealing region, the deflector wall being tilted at least in regions with respect to the normal to the sealing region at an angle of from at most 15° in the flow direction to at most 60° counter to the flow direction. A further bounding wall of the decaying space runs, for example, approximately parallel to the sealing region, which results in an upstream step upstream of the sealing region. When the valve device is open, the flow can already be deflected in the region of the decaying space approximately parallel to the sealing section and to the sealing seat, with the result that flow passes through the sealing region virtually in the entire cross section thereof.

One refinement of the disclosure provides that the deflector wall is tilted at least in regions with respect to the normal to the sealing region at an angle of from at most 5° in the flow direction to at most 20° counter to the flow direction, more preferably that the deflector wall is tilted at least in regions with respect to the normal to the sealing region at an angle of from at most 2° in the flow direction to at most 10° counter to the flow direction, even more preferably that the deflector wall is arranged at least in regions at a right angle in relation to the sealing region. In this way, ranges are described for a spatial orientation of the deflector wall, in which ranges firstly a particularly favorable ratio of low cavitation erosion and secondly a high flow speed or low pressure drop along the flow channel are achieved. The effect which is intended by the disclosure is therefore particularly high in the stated angular ranges.

Furthermore, the disclosure provides that the deflector wall is formed on a housing and/or on a valve body of the valve device. As a result, the decaying space can also be formed as an alternative or even at the same time on the housing or on the valve body. The valve device can therefore be configured structurally in a wide variety of ways.

The flow coefficient of the valve device can be improved if a bounding wall of the flow channel has a rounded portion or a bevel upstream of and close to the deflector wall. In this way, the flow speed in the sealing region can be increased further, without the cavitation erosion increasing.

Furthermore, it is provided that a bounding wall of the flow channel immediately upstream of the rounded portion has an angle with respect to a longitudinal axis of the flow channel of at most ±15°. A particularly suitable geometry of the valve device is described as a result.

The cavitation erosion can be reduced further if there is an undercut in a bounding wall of the flow channel upstream of and close to the deflector wall and/or in the deflector wall. When the valve device is closed, the hydraulic end of the fluid region which lies upstream and therefore the location of the decay of the cavitation bubbles can be kept particularly far away from the sealing region. The larger and/or deeper the undercut, the lower the cavitation erosion in general.

Further refinements provide that the valve body is of plate-shaped, cylindrical, spherical or conical configuration or that it is a double cone valve. The disclosure can be used advantageously for said geometries of the valve body and the valve device.

The production of the valve device can be simplified and made less expensive if the housing is in multiple pieces in the region of the deflector wall. As a result, the above-described wide variety of geometries of the valve device upstream of the sealing region can possibly be produced by way of separate elements and therefore in a simpler manner.

BRIEF DESCRIPTION OF THE DRAWINGS

In the following text, exemplary embodiments of the invention will be explained with reference to the drawing, in which.

DETAILED DESCRIPTION

The same designations are used for functionally equivalent elements and variables in all figures, even in the case of different embodiments.

Figure 1:
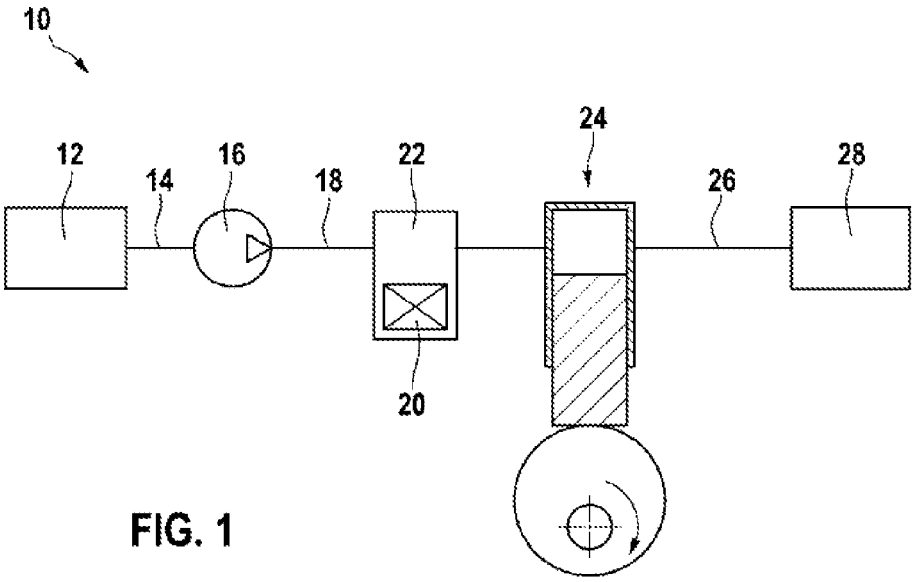
FIG. 1 shows a simplified diagram of a fuel system having a fuel pump and a valve device.

FIG. 1 shows a fuel system 10 of an internal combustion engine in a greatly simplified illustration. Fuel is fed to a high pressure pump 24 (which is not explained in further detail here) from a fuel tank 12 via a suction line 14, by means of a prefeed pump 16, via a low pressure line 18, and via a valve device 22 which can be actuated by an electromagnet 20 and is a quantity control valve 22 in the present case. Downstream, the high pressure pump 24 is connected via a high pressure line 26 to a high pressure accumulator 28. Other elements, such as outlet valves of the high pressure pump 24, are not illustrated in FIG. 1. It goes without saying that the valve device 22 or the quantity control valve 22 can be configured as one structural unit with the high pressure pump 24. For example, the quantity control valve 22 can be an inlet valve of the high pressure pump 24. Moreover, the quantity control valve 22 can also have a different actuating device than the electromagnet 20, for example a piezoelectric actuator or a hydraulic actuating means.

During operation of the fuel system 10, the prefeed pump 16 delivers fuel from the fuel tank 12 into the low pressure line 18. Here, the quantity control valve 22 determines the fuel quantity which is fed to the delivery space of the high pressure pump 24.

Figure 2:
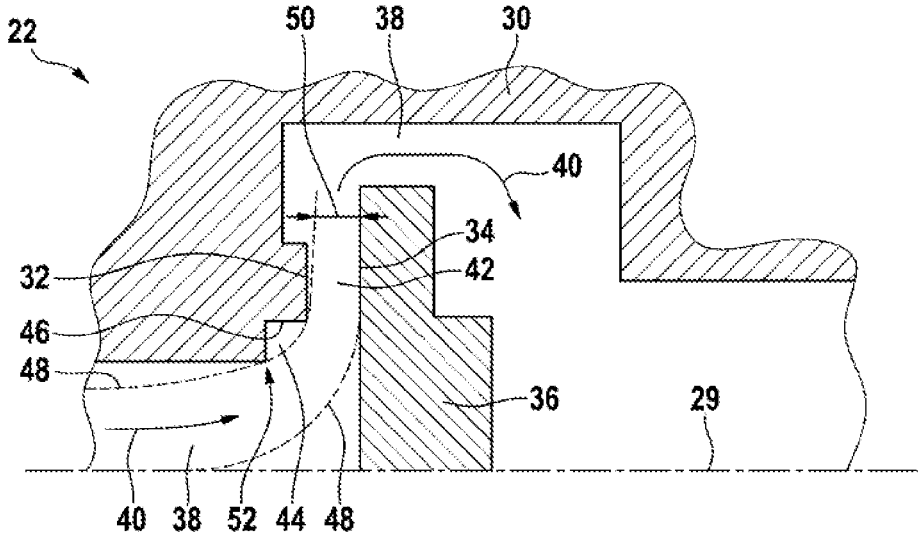
FIG. 2 shows a simplified sectional illustration of a first embodiment of the valve device from FIG. 1 in the open state.

FIG. 2 shows a first embodiment of the valve device from FIG. 1 in a simplified sectional illustration. The elements of the valve device 22 which are shown in the drawing are configured so as to be substantially rotationally symmetrical about a longitudinal axis 29 and comprise a housing 30 with a sealing seat 32, against which a sealing section 34 of a valve body 36 can bear when the valve device 22 is closed. In FIG. 2, the valve device 22 is open, however, that is to say the valve body 36 is raised up axially from the sealing seat 32. A flow channel 38 is formed in the valve device 22, through which flow channel 38 fluid (fuel in the present case) flows along the arrows 40 in the open position which is shown.

The sealing seat 32 and the sealing section 34 are configured so as to be planar and parallel to one another, and together form a sealing region 42. Upstream of the sealing region 42, a decaying space 44 is formed by means of a step-like recess in the housing 30, which decaying space 44 is delimited by a deflector wall 46 which extends at a right angle from the sealing region 42 or the plane thereof. Two dashed lines 48 along the flow channel 38 define a cross section of the flow channel 38 with a particularly high flow velocity. Downstream of the sealing region 42, the spacing of the two dashed lines 48 is characterized by a dimension 50.

It can be seen that the fuel in the drawing of FIG. 2 flows substantially from left to right in accordance with the arrows 40, the flow first of all running approximately horizontally and subsequently being deflected radially to the outside in front of the valve body 36. The deflection of the flow takes place downstream of an edge 52 in a comparatively early and low-loss manner by means of the hydraulic action of the decaying space 44. The dimension 50 is only a little smaller than the axial spacing between the sealing seat 32 and the sealing section 34, with the result that the fuel can flow comparatively quickly through the sealing region 42 and the flow coefficient of the valve device 22 is correspondingly satisfactory.

Figure 3:
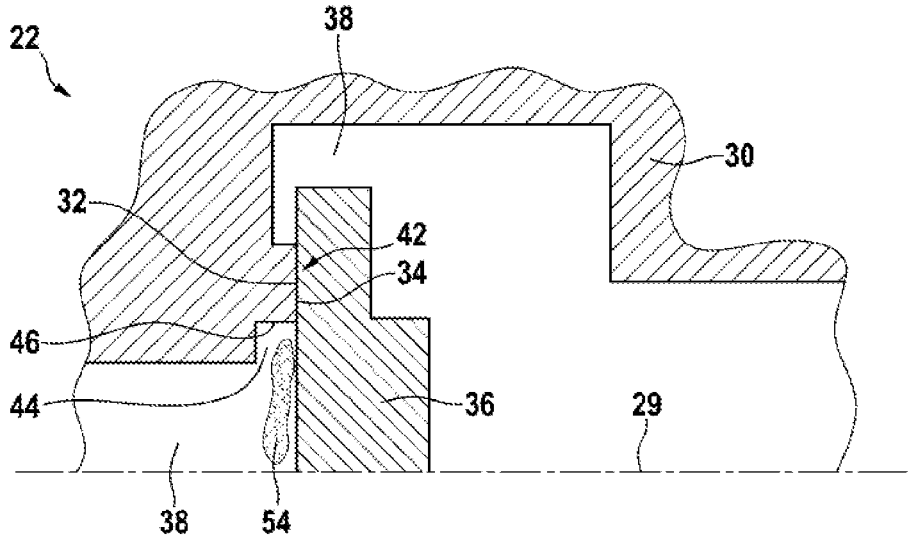
FIG. 3 shows the valve device from FIG. 2 in the closed state.

FIG. 3 shows the valve device 22 from FIG. 2 in the closed state. The valve body 36 bears with the sealing section 34 against the sealing seat 32, with the result that a throughflow of fluid substantially does not take place. A region with vapor bubbles 54 which have formed on account of cavitation effects as a result of pressure pulses is shown in the drawing to the left of the valve body 36 in an end region of the flow channel 38. The vapor bubbles 54 bear with a comparatively large surface area against the valve body 36 or are at least closely adjacent to the latter.

When the vapor bubbles 54 implode, the loading which is produced in the process is distributed to a relatively large surface area of the valve body 36 and/or the deflector wall 46, as a result of which the cavitation erosion is reduced considerably. In particular, in a surrounding area of the vapor bubble 54, the valve device 22 does not have any narrowing (wedge-like) spatial sections which are possibly particularly susceptible to cavitation erosion.

Figure 4:
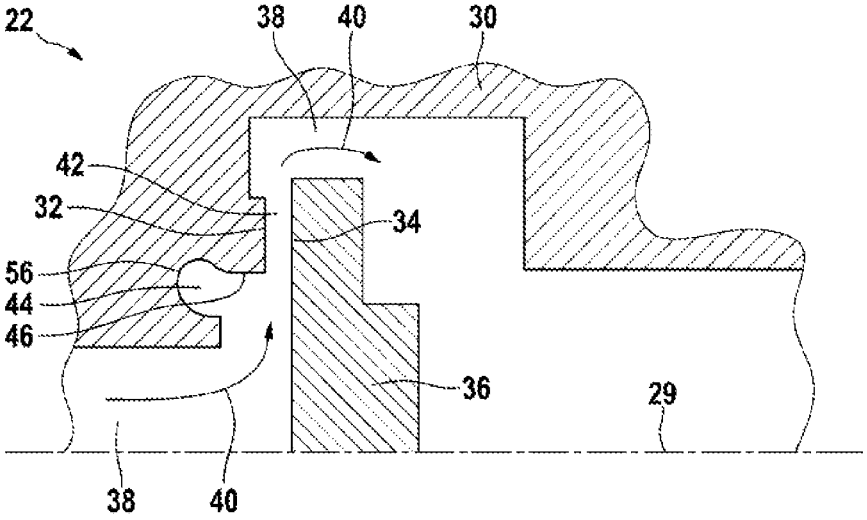
FIG. 4 shows a simplified sectional illustration of a second embodiment of the valve device.

FIG. 4 shows a further embodiment of the valve device 22, the decaying space 44 being widened by an undercut 56. In this way, the imploding vapor bubble or bubbles can be kept even further away from the sealing region 52, and the risk of cavitation erosion on the sealing seat 32 and on the sealing section 34 can therefore be reduced yet further.

Figure 5:
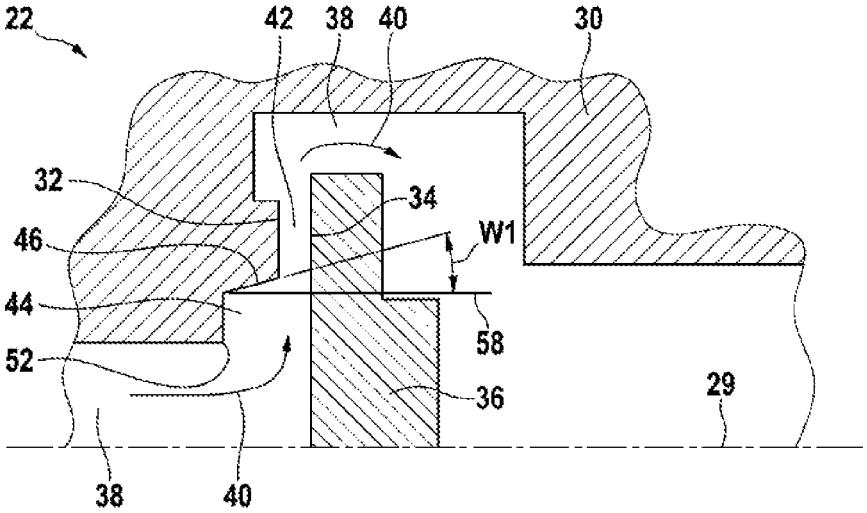
FIG. 5 shows a simplified sectional illustration of a third embodiment of the valve device.

FIG. 5 shows a further embodiment of the valve device 22, the deflector wall 46 being tilted with respect to a normal 58 to the sealing region 42 or its plane by an angle W1 of 15° in the flow direction. This results in additional possibilities for diverting the flow of the fluid and reducing the risk of cavitation erosion. The angle W1 can also be less than 15°, as a result of which the valve device 22 can be even more resistant to cavitation erosion. This is not shown in FIG. 5, however.

Figure 6:
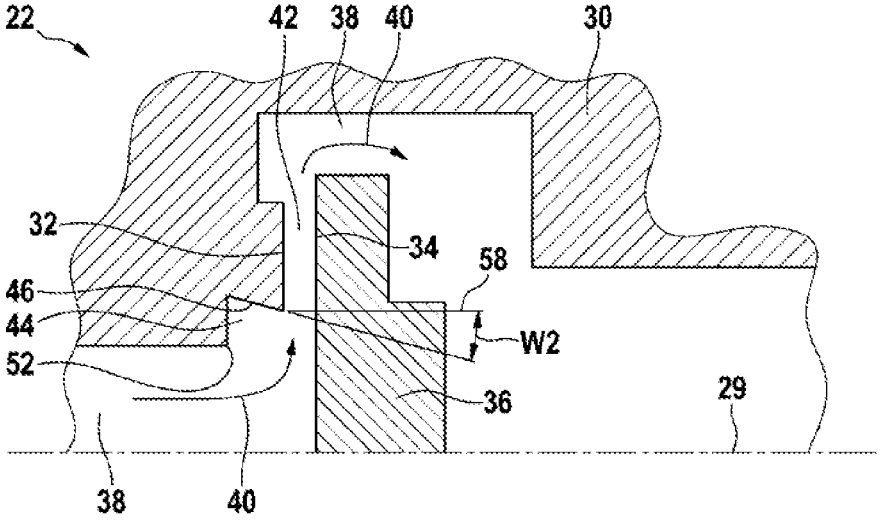
FIG. 6 shows a simplified sectional illustration of a fourth embodiment of the valve device.

FIG. 6 shows a further embodiment of the valve device 22, the deflector wall 46 being tilted with respect to the normal 58 to the sealing region 42 by an angle W2 of 15° counter to the flow direction. As a result, the risk of cavitation erosion can be reduced even further. The angle W2 can also be up to 60°. This is not shown in FIG. 6, however.

Figure 7:
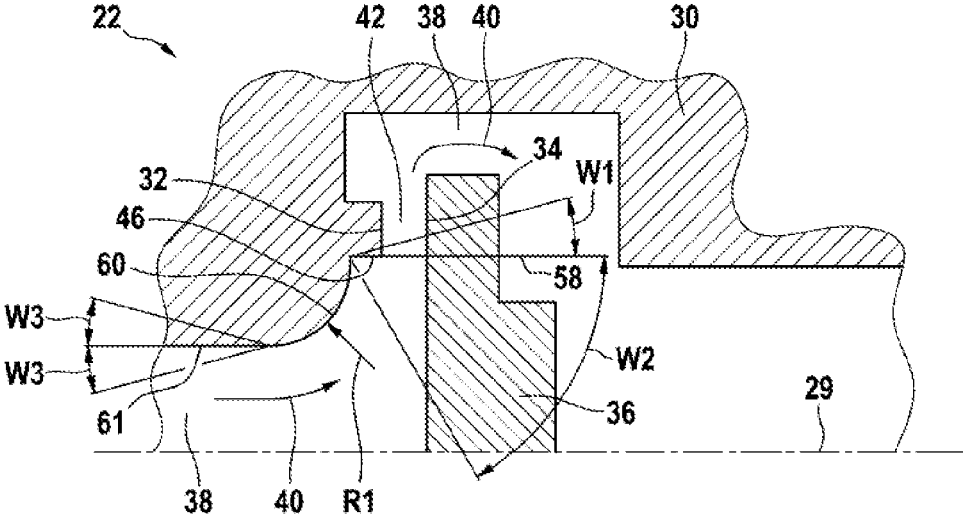
FIG. 7 shows a simplified sectional illustration of a fifth embodiment of the valve device.

FIG. 7 shows a further embodiment of the valve device 22, a bounding wall of the flow channel 38 having a rounded portion 60 with a radius R1 instead of the edge 52 upstream of and close to the deflector wall 46.

The deflector wall 46 can also be tilted with respect to the normal 58 to the sealing region 42 at most by 15° in the flow direction or, as an alternative, at most by 60° counter to the flow direction. Both alternatives are indicated in FIG. 7 by auxiliary lines. A bounding wall 61 immediately upstream of the rounded portion 60 can be tilted in relation to the longitudinal axis 29 by an angle W3 of ±15°.

Figure 8:
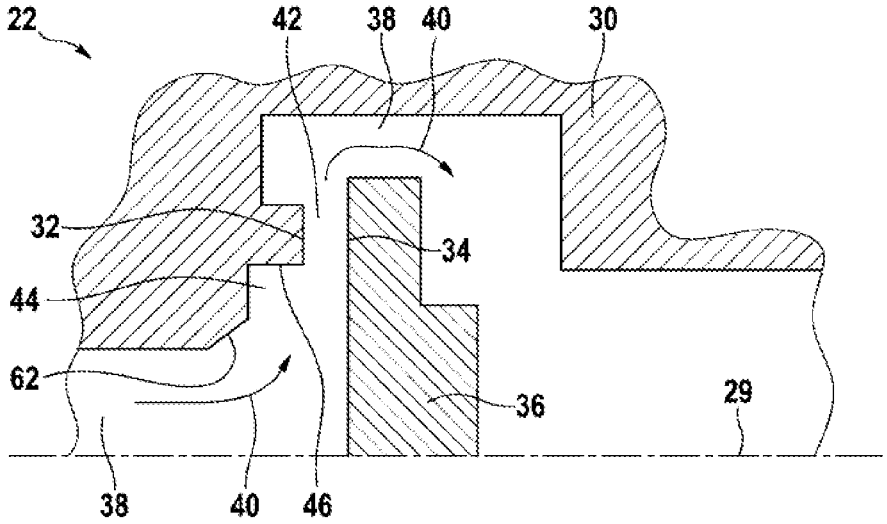
FIG. 8 shows a simplified sectional illustration of a sixth embodiment of the valve device.

FIG. 8 shows a further embodiment of the valve device 22, a bounding wall of the flow channel 38 having a bevel 62 instead of the edge 52 upstream of and close to the deflector wall 46. Here, the deflector wall 46 can likewise be tilted with respect to the sealing region by an angle W1 or by an angle W2 (cf. FIGS. 5, 6 and 7).

Figure 9:
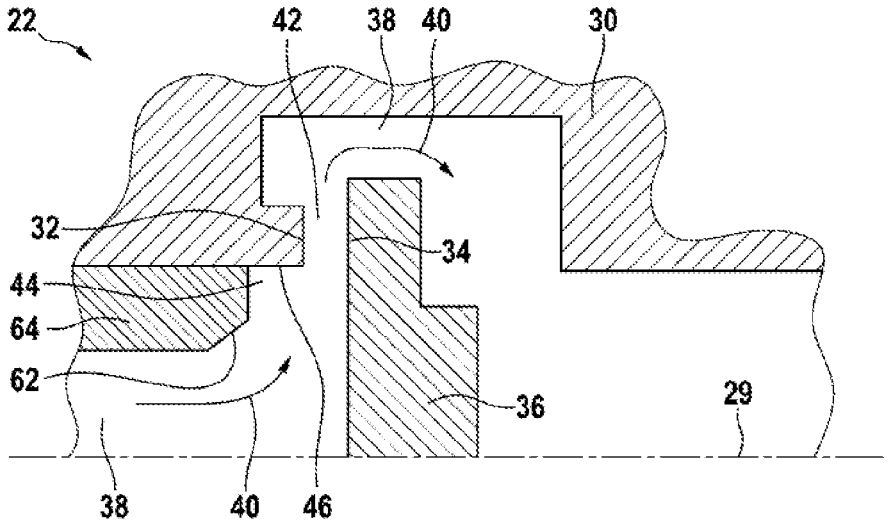
FIG. 9 shows a simplified sectional illustration of a seventh embodiment of the valve device.

FIG. 9 shows a comparable embodiment of the valve device 22 to FIG. 8, the housing 30 being configured in multiple pieces in the region of the deflector wall 46. In the present case, the bevel 62 is arranged on a housing element 64.

Figure 10:
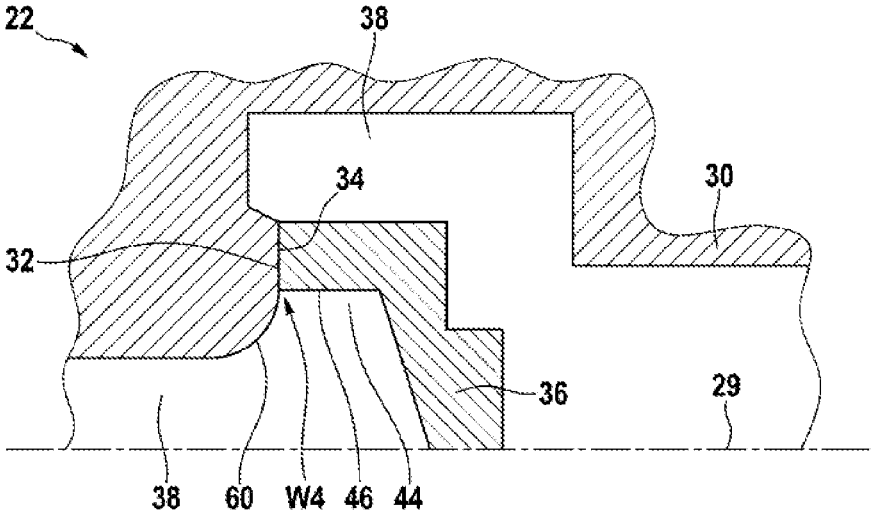
FIG. 10 shows a simplified sectional illustration of an eighth embodiment of the valve device.

FIG. 10 shows a first variant of a second group of embodiments of the valve device 22, in which the deflector wall 46 is formed on the valve body 36. This takes place by virtue of the fact that the decaying space 44 is produced on the valve body 36 by means of a recess (without designation). In a similar manner to FIG. 7, the bounding wall of the flow channel 38 has a rounded portion 60 upstream of and close to the deflector wall 46. An angle W4 in a corner of the bounding wall of the flow channel 38 and the deflector wall 46 is 90°, as a result of which a wedge-like end region of the flow channel 38 is avoided. As an alternative, the angle W4 can also be between 75° and 105° and/or the rounded portion 60 can be replaced by a bevel 62. This is not shown in FIG. 10, however.

Figure 11:
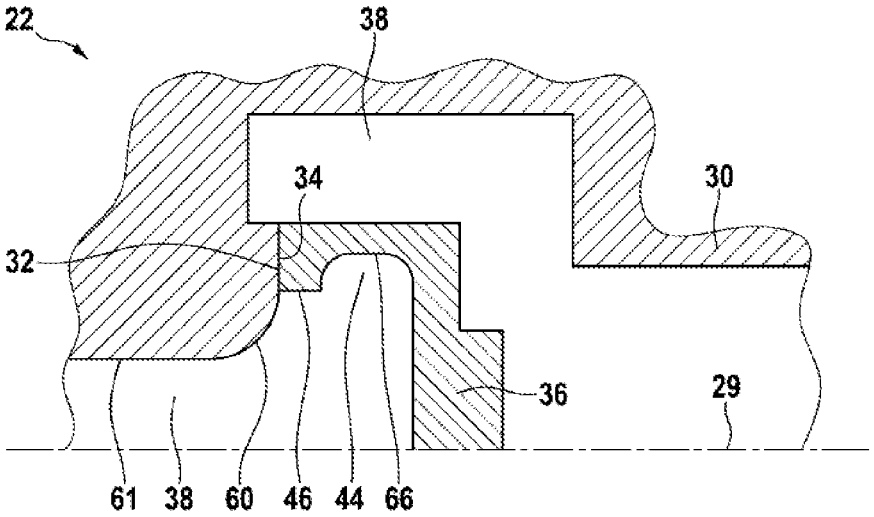
FIG. 11 shows a simplified sectional illustration of a ninth embodiment of the valve device.

FIG. 11 shows a second variant of the second group of embodiments, an undercut 66 being arranged in the valve body 36. This results in similar flow properties to the embodiment from FIG. 4. An edge 52 which is positioned upstream on the housing 30 is superfluous in the valve device 22 from FIG. 11.

Figure 12:
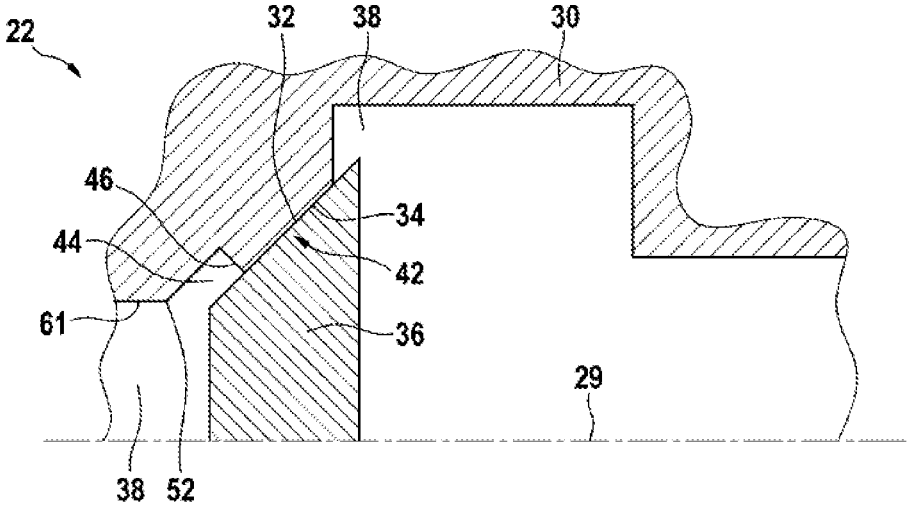
FIG. 12 shows a simplified sectional illustration of a tenth embodiment of the valve device.

FIG. 12 shows the valve device 22 in an embodiment as a double cone valve. In a surrounding area of the sealing region 42, this embodiment is similar to that of FIGS. 2 and 3. In particular, the deflector wall is oriented approximately at a right angle in relation to the sealing section 34. In FIG. 12, however, the planes of the sealing seat 32 and the sealing section 34 and the deflector wall 46 are tilted in comparison to FIGS. 2 and 3 by a defined angle (approximately by 45° in the present case) counter to the longitudinal axis 29. Accordingly, the angle at the edge 52 is also approximately 135°.

Figure 13:
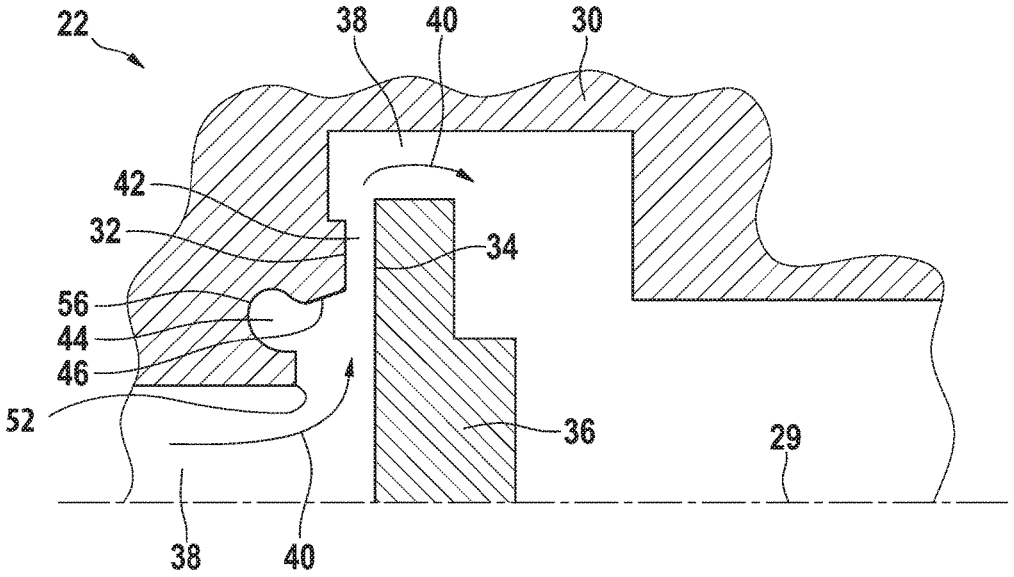
FIG. 13 shows a simplified sectional illustration of an eleventh embodiment of the valve device.

FIG. 13 shows an embodiment of the valve device 22 in which the decaying space 44 has been widened by an undercut 56 and includes a deflector wall 46 that is tilted with respect to the sealing region 52.

The embodiments shown in FIGS. 2 to 12 can be combined at least partially with one another and therefore make a multiplicity of variants of the valve device 22 possible. As shown, the valve body 36 can be of plate-shaped or conical configuration. As an alternative, however, the valve body 36 can also be of cylindrical or spherical configuration, which can also result in further variants of the valve device 22.

The invention claimed is:

1. A valve device for controlling or metering a fluid, comprising:

a housing;

a flow channel formed in the housing; and a valve body arranged in the flow channel, the valve body having a sealing section surface which, when the valve device is closed, bears against a housing-side sealing seat surface, the sealing section surface and sealing seat surface together forming a sealing region, wherein, when the valve device is closed, there is a decaying space defined in the flow channel upstream of the sealing region and adjoining the sealing region, the decaying space delimited by a deflector wall that is tilted at least in regions with respect to the normal to the sealing region at an angle of from at most 15° in the flow direction to at most 60° counter to the flow direction, wherein the decaying space is configured as a step located upstream of the sealing region, the step including a step surface that is parallel to the sealing seat surface, wherein the flow channel defines a longitudinal axis, wherein the deflector wall is located farther from the longitudinal axis than a portion of a bounding wall of the flow channel located upstream from the step surface and extending directly from the step surface, such that a diameter of the decaying space is greater than a diameter of the flow channel defined by the portion of the bounding wall, wherein a rounded portion of the portion of the bounding wall of the flow channel is located upstream of the deflector wall, and wherein another portion of the bounding wall of the flow channel is located upstream of the rounded portion and has an angle with respect to a longitudinal axis of the flow channel of at most ±15°.

2. The valve device as claimed in claim 1, wherein at least a portion of the deflector wall is tilted with respect to the longitudinal axis at an angle of from at most 5° in the flow direction to at least 20° counter to the flow direction.

3. The valve device as claimed in claim 1, wherein there is an undercut in the bounding wall of the flow channel upstream of the deflector wall and/or in the deflector wall.

4. The valve device as claimed in claim 1, wherein the valve body is of plate-shaped, cylindrical, or conical configuration or is configured as a double cone valve.

5. The valve device as claimed in claim 1, wherein the housing is configured with multiple pieces.

6. A quantity control valve of a fuel system of an internal combustion engine, comprising:

a valve device including:

a housing;

a flow channel formed in the housing; and a valve body arranged in the flow channel, the valve body having a sealing section which, when the valve device is closed, bears against a housing-side sealing seat surface, the sealing section and sealing seat surface together forming a sealing region, wherein, when the valve device is closed, there is a decaying space defined in the flow channel upstream of the sealing region and adjoining the sealing region, the decaying space delimited by a deflector wall that is tilted at least in regions with respect to the normal to the sealing region at an angle of from at most 15° in the flow direction to at most 60° counter to the flow direction, and wherein the decaying space is configured as a step located upstream of the sealing region, the step including a step surface that is parallel to the sealing seat surface, wherein the flow channel defines longitudinal axis, wherein the deflector wall is located farther from the longitudinal axis than a portion of a bounding wall of the flow channel located upstream from the step surface and extending directly from the step surface, such that a diameter of the decaying space is greater than a diameter of the flow channel defined by the portion of the bounding wall, wherein a rounded portion of the portion of the bounding wall of the flow channel is located upstream of the deflector wall, and wherein another portion of the bounding wall of the flow channel is located upstream of the rounded portion and has an angle with respect to a longitudinal axis of the flow channel of at most ±15°.

7. The valve device as claimed in claim 1, wherein at least a portion of the deflector wall is tilted with respect to the longitudinal axis at an angle of from at most 2° in the flow direction to at most 10° counter to the flow direction.

8. The valve device as claimed in claim 1, wherein the deflector wall is arranged at a right angle in relation to a plane defined by the sealing region.

9. The valve device as claimed in claim 1, wherein:

the sealing seat surface is flat and annular, and the step surface is flat and annular.

10. The valve device as claimed in claim 1, wherein:

the sealing seat surface defines a first width in a radial direction with respect to the longitudinal axis, the step surface defines a second width in the radial direction, and the first width is greater than the second width.

11. The valve device as claimed in claim 1, wherein the entire sealing seat surface is positioned against the valve body.

12. The valve device as claimed in claim 1, wherein:

the sealing seat surface is entirely located in a first plane, the step surface is entirely located in a second plane, and the first plane is parallel to the second plane.

13. The valve device as claimed in claim 12, wherein the first plane and the second plane are perpendicular to the longitudinal axis and are spaced apart from each other along the longitudinal axis.

* * * * *